US007029223B2

(12) United States Patent
Devesa Company

(10) Patent No.: US 7,029,223 B2
(45) Date of Patent: Apr. 18, 2006

(54) PROCEDURE FOR CONSTRUCTION OF MULTI-LAYER CYLINDRICAL CONTAINERS AND CONTAINERS SO OBTAINED

(76) Inventor: Joaquin Devesa Company, Avda. Benidorm 18, Benasau, Alicante (ES) 03814

( * ) Notice: Subject to any disclaimer, the term of this patent is extended or adjusted under 35 U.S.C. 154(b) by 232 days.

(21) Appl. No.: 10/691,728

(22) Filed: Oct. 23, 2003

(65) Prior Publication Data

US 2004/0096297 A1 May 20, 2004

(30) Foreign Application Priority Data

Nov. 20, 2002 (ES) ..... 200202665
Feb. 24, 2003 (ES) ..... 200300436

(51) Int. Cl.
*B21D 51/26* (2006.01)

(52) U.S. Cl. ..... 413/2; 413/8; 493/111; 220/62.22

(58) Field of Classification Search ..... 413/1, 413/2, 4, 5, 8, 9, 18, 69, 78; 493/102, 110, 493/111; 220/62.12, 62.22
See application file for complete search history.

(56) References Cited

U.S. PATENT DOCUMENTS 3,125,056 A * 3/1964 Kaiser ..... 413/1
4,996,823 A * 3/1991 Byrne ..... 53/410
5,069,590 A * 12/1991 Stoffel ..... 413/1
5,495,445 A * 2/1996 Proebsting ..... 365/200
5,779,424 A * 7/1998 Stoffel ..... 413/1
6,241,095 B1 * 6/2001 Yencheng ..... 206/459.1

FOREIGN PATENT DOCUMENTS

GB 2298188 A * 8/1996

* cited by examiner

*Primary Examiner*—Derris H. Banks
*Assistant Examiner*—Jimmy T. Nguyen
(74) *Attorney, Agent, or Firm*—Collard & Roe, P.C.

(57) ABSTRACT

The sheets (1) and (2) are cut separately in rectangular shapes and with one of their corners recessed (1.2) and (2.4) and the sheet (1) slightly larger than the other one, double, on layer (2.1) an alignment of cylindrical lenses (2.2) which reflect images from the other internal sub-sheet (2.3), the two sheets (1) and (2) are superimposed; they are joined and their rims hooked together, in a tube (3) with the vertical upper recesses; a small flange (1.3) is configured at the top covering the rim of the sheet (2), except for the recess thereof, with one of the ends of the small flange (1.3) overlapping the other; the lip (1.4) is inserted in the stepped piece (4.1) of the bottom (4) of the container; the latter is flanged (4.2).

4 Claims, 4 Drawing Sheets

PROCEDURE FOR CONSTRUCTION OF MULTI-LAYER CYLINDRICAL CONTAINERS AND CONTAINERS SO OBTAINED

OBJECT OF THE INVENTION

The invention disclosed herein consists of a procedure for construction of multilayer cylindrical containers and containers so obtained, of among the different containers on the market intended for the purpose of conservation and exhibition of individual products.

This invention is characterized in a special construction of the container, of multi-layer tubular constitution, the interior in sheet metal and the exterior in cylindrical lenticular thermoplastic material.

This invention is also characterized in a special construction of the cover of the container, in any geometric configuration thereof, as well as having a base both flat and curved.

BACKGROUND OF THE INVENTION

The containers for conservation and exhibition of individual products add value to the latter and are excellent means of advertising the same.

These means of exhibition are built in the most diverse materials and forms and are based on erectable laminar pieces or on others with very diverse finishes. Within the tubular elements, one starts with a curved metallic sheet with hooked ends, or a plastic sheet, welding it by the rims of its longest longitudinal sides.

Then the two opposing bases and the product inside the enclosure so built are incorporated.

The applicant is unaware of the existence of multi-layer containers, metallic and of plastic material, of the characteristics of that disclosed herein.

DESCRIPTION OF THE INVENTION

The invention object of the present specification relates to a procedure for construction of multi-layer cylindrical containers and the obtained containers, the procedure of this invention being characterized in:

Cutting both sheets, the sheet of plastic material being slightly less in height, and, simultaneously, carrying out the recessing thereof in one of their corners, this recessing being also dimensionally smaller in the sheet of plastic than in the metallic one.

Superimposing the same, without adhesives.

Uniting their end sides and hooking them together, configuring with both sheets, the metallic one and that of plastic, with a tube.

Configuring a small flange, by rounding off the upper rim of the metallic sheet, covering the rim of that of plastic, with overlapping of one of the ends on the other one, in the area of the corner recess of both sheets.

Inserting the lower lip of the metallic sheet in the conventional internal stepped bottom of the container.

The flanging of the bottom, the introduction of the product and inserting the cover also conventional.

This invention is likewise characterized in a special construction of the cover of the container, in any geometric configuration of the rim and of the skirt thereof, round, oval, polygonal or mixing straight segments with other curved ones, as well as arranging the base thereof to be both flat or curved concavely or convexly.

To such ends it has a special construction of the cover, both for the application thereof in cylindrical tubular or polyhedral containers, of laminar origin and for others of less height, conventional of stamped body and rim finished off by roller, tampon or another known procedure of finishing rims, which hold secure both layers of sheets, previously conformed, appropriately superimposed and the layer of plastic being of slightly smaller dimensions than the metallic one in order to proceed, thereafter, to form a small flange edging the projecting segment of the metallic layer over the rim of the plastic layer.

DESCRIPTION OF THE DRAWINGS

The present descriptive specification is completed with a set of drawings, which illustrate in a non-restrictive manner the preferred embodiment of the invention.

PREFERRED EMBODIMENT OF THE INVENTION

Figure 1:
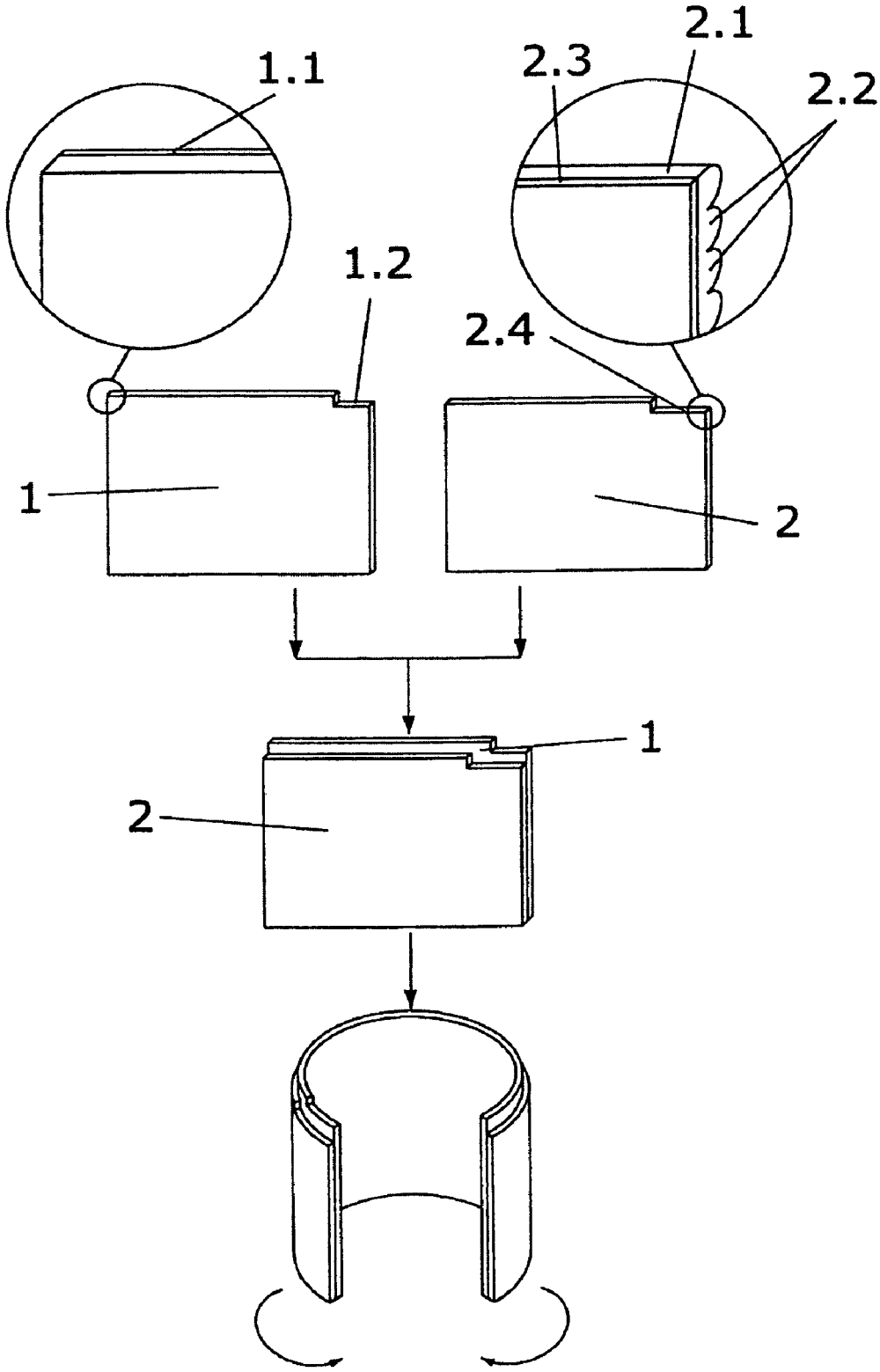
FIG. 1 is a plan of the over-mounting of the sheets and the corner cutting thereof.
Figure 2:
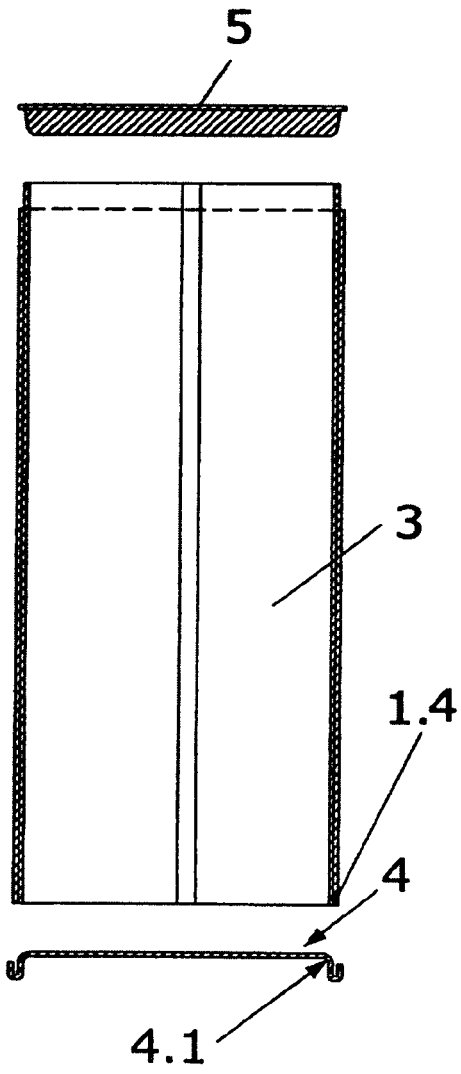
FIG. 2 shows an elevation in section of a container of the invention, exploded to show bottom and cover.
Figure 3:
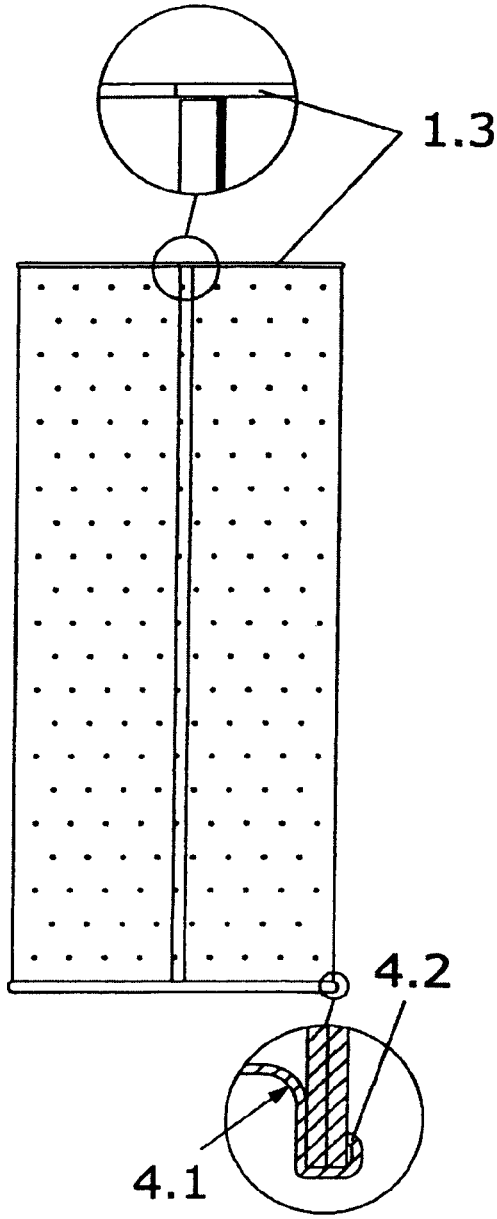
FIG. 3 is the container, once closed, with details of the finish of the small flange overlapping both sheets and of the flanging of the bottom.
Figure 4:
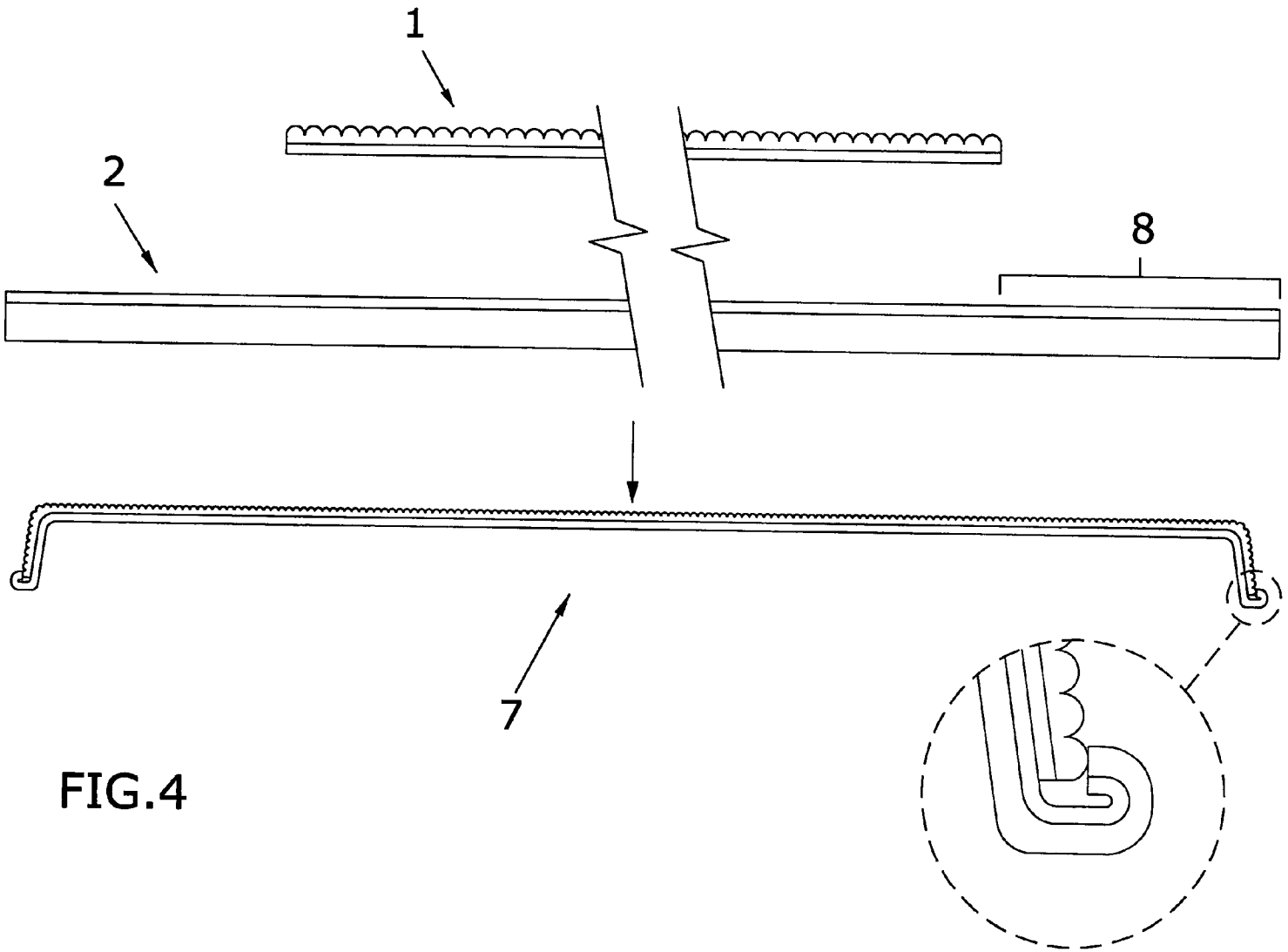
FIG. 4 shows the construction of the circular cover of the preferred embodiment, as well as a detail of its finish.
Figure 5:
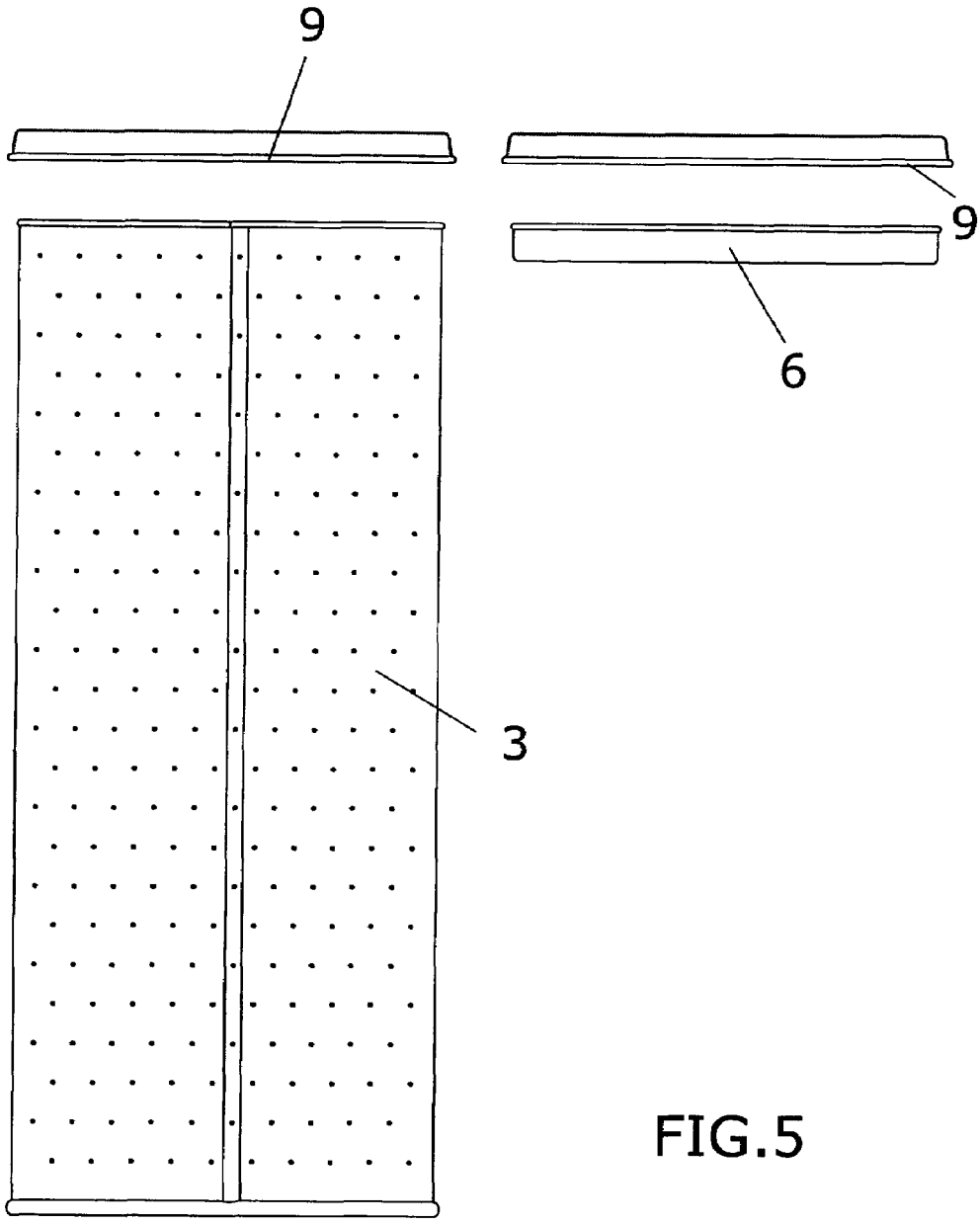
FIG. 5 shows its application to the tubular container of laminar origin, of the main patent, as well as to a stamped box for holding CDs.

In the light of that described above, the present invention relates to a container procedure for construction of multi-layer cylindrical containers and containers so obtained.

The same belongs to the group of the different containers on the market intended for the purpose of conservation and exhibition of individual products and, more particularly, to that of drinks of high unit price, although its application can extend to other products, including non-alimentary.

This invention is characterized in a special construction of the container, with conventional cover and bottom, as well as tubular multi-layer constitution, the interior in sheet metal and the exterior in cylindrical lenticular thermoplastic material.

To this end, one proceeds to cut both sheets in rectangular shapes, one of them, the interior sheet (1), in conventional metallic material, preferably of the same type as the cover and the bottom, which can be provided or not with another metallic coating (1.1).

While the other sheet (2) is cut slightly smaller in height, the plastic material is double with an external layer (2.1) which presents an alignment of a multiplicity of cylindrical sectors (2.2) which constitute lenses which, depending on the viewing angle, reflect diverse images incorporated in the innermost plastic sub-sheet (2.3).

One likewise proceeds, simultaneously with each of these sheets (1) and (2), to the respective cutting of recesses (1.2) and (2.4) of one of their corners, which subsequently must be in the upper vertical position. It must also be satisfied that this recessing is dimensionally smaller in height in the double sheet (2) of plastic than in the metallic one (1).

The two sheets (1) and (2) are superimposed, without adhesives and, with simple appropriate tools, are mutually secured to each other.

Then their end sides are joined and hooked to each other conventionally, configuring a tube (3) with both sheets, the metallic one and that of plastic.

At the top, one proceeds thereafter to configure a flange (1.3), by rounding off the rim of the metallic sheet (1), which covers the rim of that of plastic, so that one of the ends of the small flange overlaps the other, in the area of the corner recess of both sheets.

Thus the plastic sheet (2) is completely embedded, by its upper horizontal rim, inside the small flange (1.3) of the metallic sheet (1), except in the segment of the recess (2.4), which is flush with the lower rim of the small flange (1.3). Thus the overlapping of the flange (1.3) is uniform over the whole mouth of the tube (3), by not being superimposed on the bend of the hook of the plastic sheet (2). Of the lower vertical side, the lip (1.4) of the metallic sheet, resulting from the larger cut in the plastic sheet that is abutting against it, is that which is used for inserting the stepped (4.1) conventional internal bottom piece (4) of the container.

It is then sufficient to flange (4.2) the bottom to finish the same, introduce the product and insert a conventional cover (5).

Alternatively, when the body (6) need not have an excessive height it can be built by pressing, the same as the cover (7), by mounting previously stamped, formed and superimposed the plastic sheets (1) on the metallic sheet or sheets (2), the sheet or sheets (2) leaving a rim (8) projecting beyond the sheets (1) on all the periphery thereof, proceeding finally to form a small flange (9) edging the projecting rim (8) of the metallic sheet or sheets (2) over the rim of the plastic layer (1}.

This pressed body (6), in different heights depending on the requirements and the pressing technique applied, is intended to hold both the aforementioned CDs and any other product, be this alimentary (cakes, sweets, biscuits, chocolates in compartmented trays, etc.) or garments (underwear, accessories and others) or any product of high unit value and capable of being packed.

Both the tube (3) and the equivalent body (6) are prepared with any geometric configuration of the rim and the skirt: round, oval, polygonal or mixing straight segments with other curved ones, as well as having the base thereof both in a flat form and curved concavely or convexly.

The essential nature of this invention is not altered by variations in materials, form, size and arrangement of the component elements, described in a non-restrictive manner, this being sufficient for an expert to proceed to the reproduction thereof.

The invention claimed is:

1. A process for construction of a multi-layer cylindrical container comprising the steps of:

(a) cutting separately a first sheet and a second sheet in rectangular shapes and with one corner of each sheet having a recess, the first sheet forming an interior sheet, the first sheet being slightly greater in height than the second sheet and being slightly greater in height in the recess, and the first sheet being made of a metallic material; the second sheet comprising at least two layers, including an external layer of plastic material and an inner layer of plastic material, the external layer having a plurality of cylindrical areas forming lenses, the lenses, depending on viewing angle, reflecting different images incorporated on the inner layer of plastic material;

(b) superimposing the first and second sheets without adhesives and securing the first and second sheets to each other;

(c) uniting end sides of the first and second sheets by hooking the end sides together to form a tube from the first and second sheets so that one corner of the first and second sheets is in an upper vertical position;

(d) rounding off a rim of the first sheet to form a small flange at a top portion of the first sheet covering a rim of the second sheet so that one end of the flange overlaps another end of the flange in an area of the recesses of the first and second sheets, leaving an upper horizontal rim of the second sheet completely embedded in the flange of the first sheet except in a segment of the recess, wherein the upper horizontal rim of the second sheet is flush with a lower rim of the flange;

(e) inserting a lower lip of the first sheet in a bottom piece of the container, the bottom piece being provided with a stepped portion; and (f) flanging the bottom piece to leave the bottom piece ready for introduction of a product and for insertion of a cover.

2. The process according to claim 1 wherein the tube is constructed by pressing the second sheet on the first sheet, the first sheet leaving a rim peripherally projecting from each of the first and second sheets, and forming a small flange on an edge of the projecting rim of the first sheet over the rim of the second sheet.

3. A multi-layer cylindrical container having a tubular multi-layer construction comprising:

(a) a first interior metallic sheet having a first recess in a corner of said first interior metallic sheet;

(b) a second exterior plastic sheet having a second recess in said corner, wherein said first interior metallic sheet is slightly greater in height than the second exterior plastic sheet and slightly greater in height in said second recess than said first recess, said second exterior sheet comprising an external first layer made of plastic material and having a plurality of cylindrical areas forming lenses and a second layer made of plastic material;

(c) a small flange provided in an interior portion of the first interior metallic sheet;

(d) a rim of the second exterior plastic sheet flush with a lower rim of the flange; and (e) a lower lip of the first interior metallic sheet inserted in a bottom piece of the container, the bottom piece being provided with a stepped portion.

4. The multi-layer cylindrical container according to claim 3 wherein the container comprises a tube and a base, the tube having a rim and a skirt with a geometrical configuration selected from the group consisting of round, oval, polygonal and a mixture of straight and curved segments, and the base having a flat, concave, or convex form.

* * * * *

UNITED STATES PATENT AND TRADEMARK OFFICE

CERTIFICATE OF CORRECTION

PATENT NO. : 7,029,223 B2
APPLICATION NO. : 10/691728
DATED : April 18, 2006
INVENTOR(S) : Devesa It is certified that error appears in the above-identified patent and that said Letters Patent is hereby corrected as shown below:

In particular, in Column 3, lines 55-56 (lines 7-8 of Claim 1), please change "being slightly greater in height in the recess" to: --the recess of the first sheet being slightly greater in height than the recess of the second sheet--.

In Column 4, line 24 (Line 1 subparagraph (f) of Claim 1), please change "bottom piece" (second occurrence) to: --tube--.

In Column 4, line 38 (Line 2 of subparagraph (b) of Claim 3), please change "said corner" to:
--a corner of said second exterior plastic sheet--.

Lines 26-27 (lines 4-5 of subparagraph (b) of Claim 3), please change "slightly greater in height in said second recess than said first recess" to: --the first recess is lightly greater in height than the second recess--.

Signed and Sealed this

Twenty-second Day of August, 2006

JON W. DUDAS
*Director of the United States Patent and Trademark Office*